United States Patent [19]

Ruprecht

[11] Patent Number: 4,945,802

[45] Date of Patent: Aug. 7, 1990

[54] PNEUMATIC RETURN FOR FOOT PEDALS ASSOCIATED WITH PERCUSSION INSTRUMENTS

[76] Inventor: David S. Ruprecht, 11635 Glendora Lane, Parma Heights, Ohio 44130

[21] Appl. No.: 295,537

[22] Filed: Jan. 11, 1989

[51] Int. Cl.[5] ..... G10D 13/00; G10C 3/26

[52] U.S. Cl. ..... 84/422.1; 84/225; 84/422.3; 84/426; 84/444

[58] Field of Search ..... 84/24, 72–78, 84/225–232, 312 P, 353, 357, 358, 366, 426, 444, 422.1, 422.2, 422.3

[56] References Cited

U.S. PATENT DOCUMENTS

| | | | |
|---|---|---|---|
| 886,471 | 5/1908 | Britton | 84/422.2 |
| 907,207 | 12/1908 | Weser | 84/77 |
| 3,381,565 | 5/1968 | Haile | 84/444 |
| 3,797,356 | 3/1974 | Duffy et al. | 84/422.1 |
| 4,121,490 | 10/1978 | Deutsch | 84/1.27 |
| 4,152,967 | 5/1979 | Barron | 84/236 |
| 4,206,677 | 6/1980 | Ramsey | 84/107 |
| 4,756,224 | 7/1988 | Lombardi | 84/422.1 |

FOREIGN PATENT DOCUMENTS

| | | | |
|---|---|---|---|
| 22719 | of 1902 | United Kingdom | 84/426 |
| 4336 | of 1914 | United Kingdom | 84/72 |

OTHER PUBLICATIONS

Article Entitled "Bass Drum Pedals" (Three Pages).

*Primary Examiner*—Lawrence P. Franklin
*Attorney, Agent, or Firm*—Nixon & Vanderhye

[57] ABSTRACT

A pneumatic foot pedal assembly for percussion instruments such as bass drums and hi-hat stands. The assembly permits adjustable mounting of a drum beater bar, foot pedal and drive chain while providing automatic return of the pedal to a neutral position by means of gas compressed upon depression of the pedal. Gas pressure within the pneumatic return mechanism is also adjustable. There is further optionally provided a substantially identical pneumatic unit for damping the return movement of both the drum pedal and hi-hat stand.

32 Claims, 5 Drawing Sheets

FIG. 6
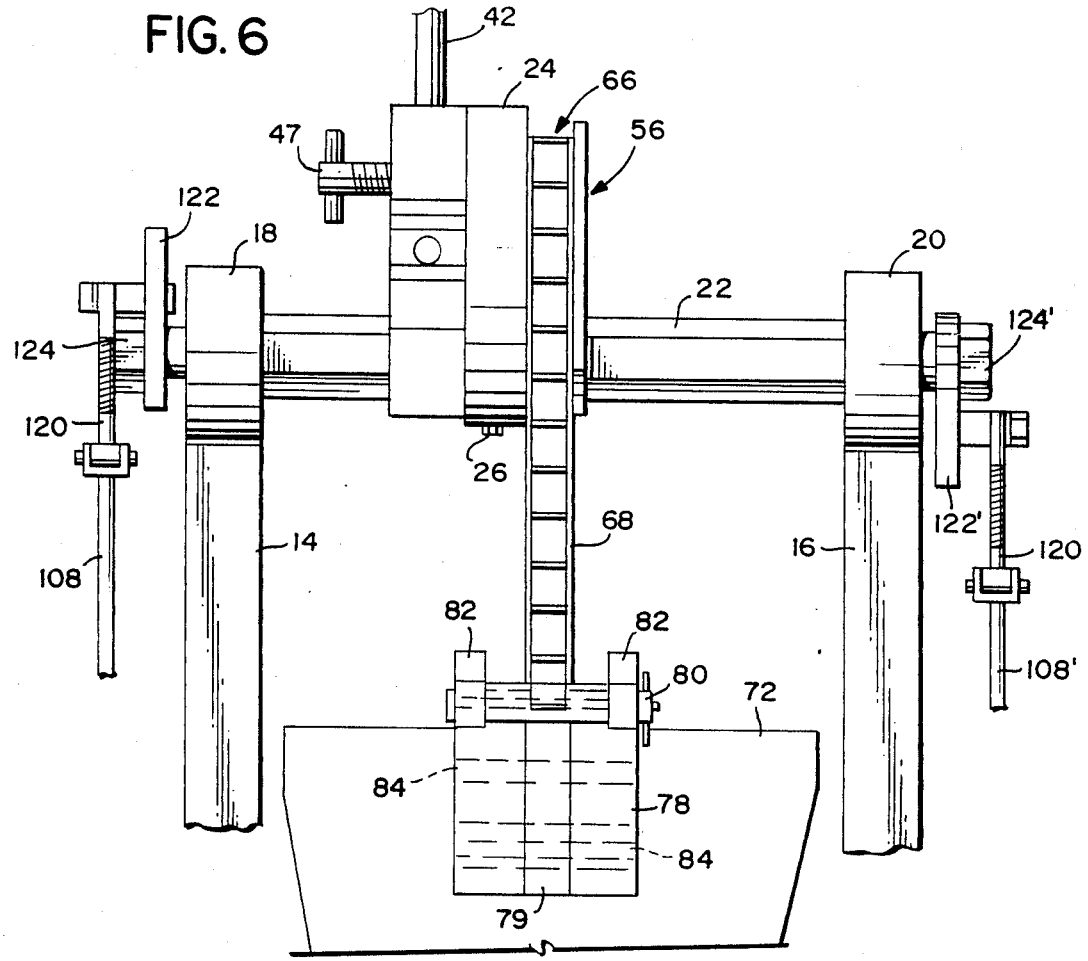
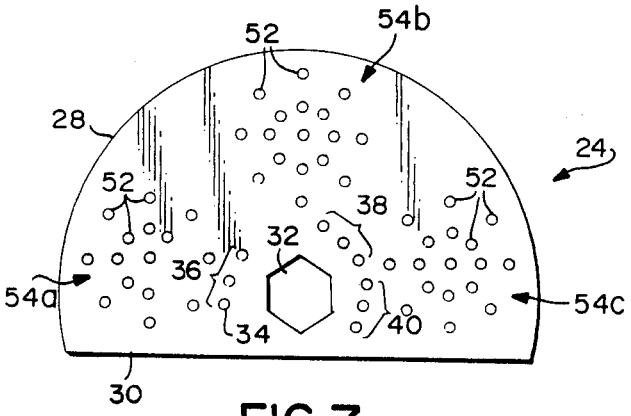
FIG. 7
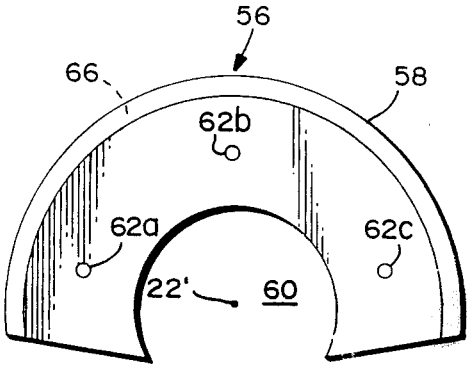
FIG. 9

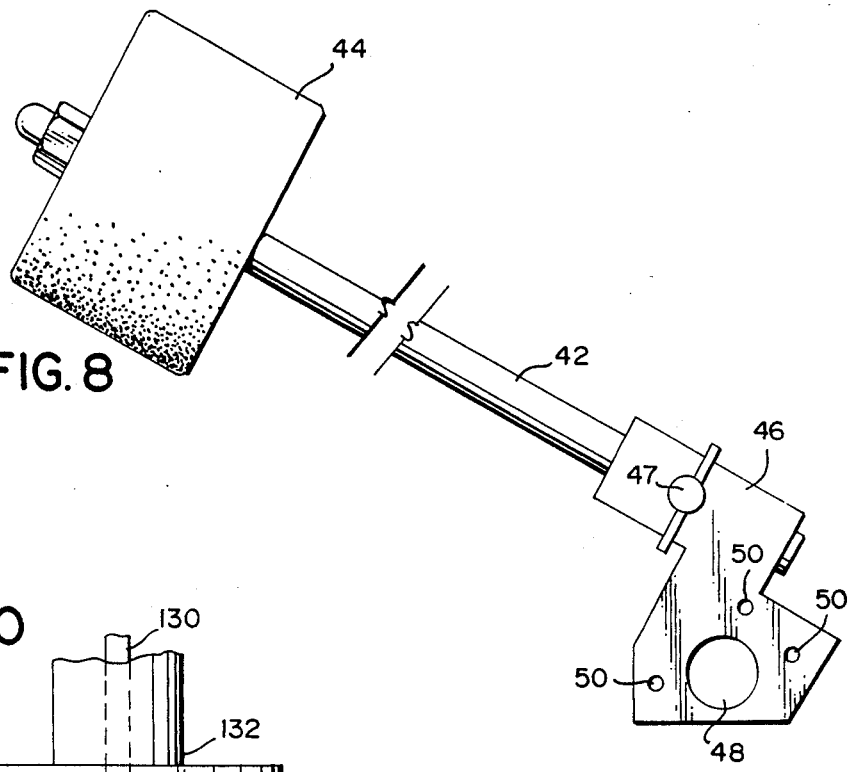
FIG. 8
FIG. 10
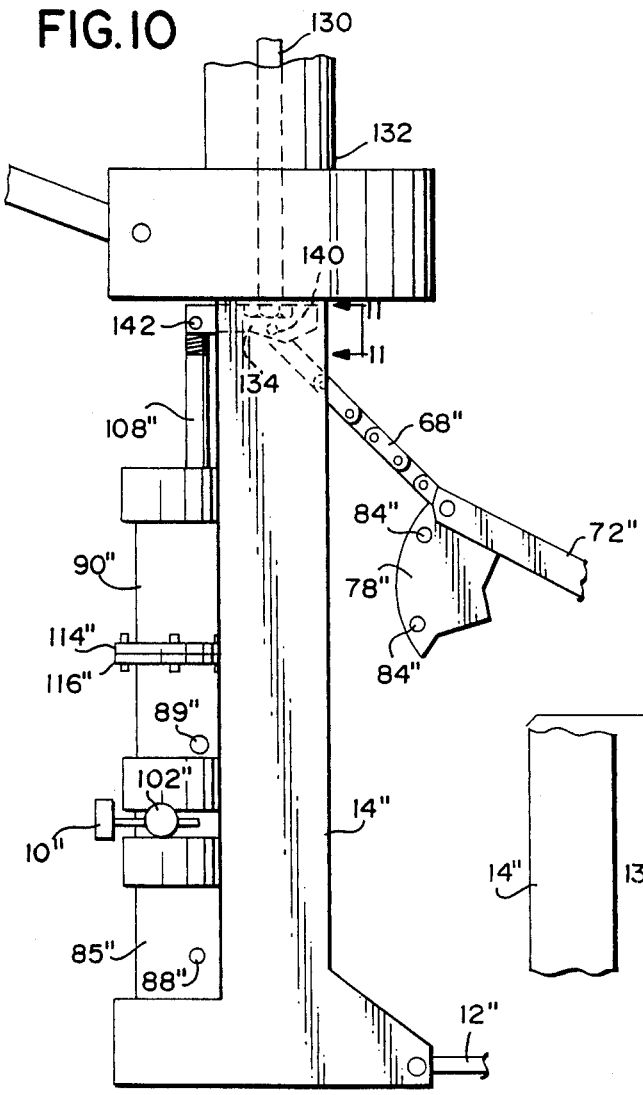
FIG. 11
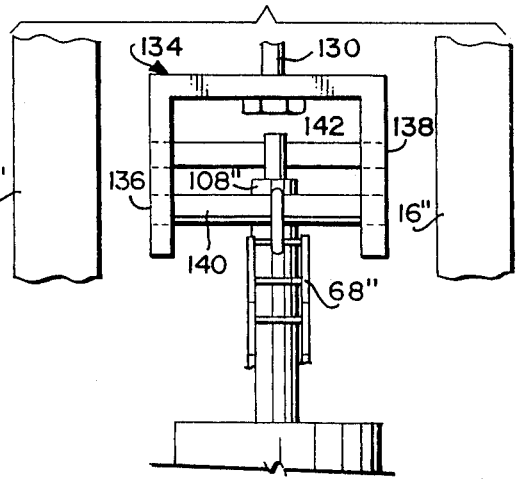

PNEUMATIC RETURN FOR FOOT PEDALS ASSOCIATED WITH PERCUSSION INSTRUMENTS

BACKGROUND AND SUMMARY OF THE INVENTION

The present invention relates to percussion-type musical instruments and, more specifically, to pedal actuated bass drums and hi-hat stands.

There are presently known pedal actuated drum beating mechanisms which operate to drive a beater bar and attached beater head by means of an adjustable chain drive which acts in opposition to a coil spring which thereafter returns the pedal and beater bar to a neutral position. Limited adjustments to the angle of inclination of the pedal and spring tension are possible in these mechanisms. Examples may be found in U.S. Pat. Nos. 4,756,224 and 3,797,356.

The known mechanisms have not proven to be completely satisfactory, however, insofar as the coil springs tend to lose their elasticity over time. They also tend to be noisy and are not easily calibrated. In order to obtain a different feel, i.e., movement, resistance to movement, beater bar speed, timing, etc., it is oftentimes necessary to purchase an entire new pedal assembly. Substitution of different size springs, where possible, can also be a time consuming chore.

Similar mechanisms are used in the actuation of hi-hat stands, and similar problems are experienced.

The present invention has for its principal objective the ability to customize or precisely "tune" the movement and return of bass drum or hi-hat stand pedals to achieve a desired, and virtually infinitely variable "feel" or "character".

In accordance with one exemplary embodiment of the invention, the known return coil spring arrangement is replaced by a pneumatic system which enables the user to effect precise and repeatable settings and adjustments, to thereby achieve a smooth, quiet "feel", with none of the disadvantages of the known coil spring-controlled systems.

In this regard, the invention disclosed herein also permits several additional adjustments for varying operating characteristics which heretofore have been obtainable only by changing pedals.

In one exemplary embodiment, the invention includes a frame supporting a foot pedal for rotation about a first axis, and a flexible drive member, preferably a chain, which operatively links the end of the pedal remote from the first axis to a bass drum beater bar. It will be understood that other flexible drive members may be used, such as a belt or other suitable means.

In this exemplary embodiment, a base or yoke supports a pair of upstanding pedestals, between which extends an axle mounted for rotation therein. A main hub is mounted on the axle, and the hub, in turn, adjustably supports a drum beater bar and associated beater head for rotational movement along with the axle. An adjacent track hub member, fixedly but adjustably secured to the main hub, supports one end of a chain, while the other end of the chain is connected to one end of the pivotally mounted footboard, or pedal. As in conventional drum pedal mechanisms, when the footboard or pedal is depressed, it pulls the chain downwardly, causing rotation of the axle and hub members mounted thereon, thereby causing a striking movement of the beater bar. In this exemplary embodiment, however, a number of adjustments are possible to customize the "feel" of the pedal assembly. For example, the orientation of the beater bar relative to the axle, and the orientation of the track hub to the main hub may be varied from a true center rotational orientation to an eccentric rotational orientation, to alter the path, speed and timing of the beater bar. In addition, the mounting position of the one end of the chain on the track hub may also be varied, and the mounting position of the other end of the chain relative to the footboard may be varied to alter the angle of inclination of the pedal, and the stroke length of the beater bar.

As a result of such features, a virtually infinite number of adjustments are available to customize the characteristics and "feel" a drum pedal or hi-hat stand assembly.

In addition, the present invention also provides a pneumatic pedal return mechanism in place of the known coil spring arrangements. In one exemplary embodiment of the invention, a rolling diaphragm type piston and cylinder assembly is adjustably connected via a dual pivot link arm to a cam mounted on the axle. When the axle rotates, the cam also rotates, varying the moment arm of the link arm, and causing the rolling diaphragm and piston to move within a chamber to compress the gas therein. Upon cessation of the downward movement of the pedal (for example, upon removal of the user's foot), the fluid expands, reversing the movement of the rolling diaphragm/piston assembly, and hence also the axle, beater bar and pedal, returning them to a neutral position.

In the pneumatic system of this invention, a compression chamber is charged with gas from a main pressure chamber in a manner that permits the pressure in the compression chamber to be varied, to thereby permit even further customization of the performance characteristics of the assembly.

In a further aspect of the invention, a pneumatic damping unit is provided to resist, or dampen, the return movement of the pedal. The damping unit is substantially identical to the pneumatic return unit, but is mounted on the other side of the axle so that the movement of the respective rolling diaphragm/piston assemblies act in opposition to each other as will be described further hereinbelow.

In a further feature of the invention, the pneumatic return system is incorporated into a hi-hat stand unit to provide a similar capability to customize the assembly to provide the desired characteristics and "feel".

Other objects and advantages of the invention will become apparent from the detailed description which follows.

BRIEF DESCRIPTION OF THE DRAWINGS

FIG. 6 is a partial front view of the drum foot pedal assembly as shown in FIGS. 1 and 3;

FIG. 7 is a side view of a main hub for adjustably mounting a drum beater bar in accordance with the invention;

FIG. 8 is a side view of a drum beater bar in accordance with the invention;

FIG. 9 is a side view of a track hub for adjustably mounting a drive chain in accordance with the invention;

FIG. 10 is a partial side view of a hi-hat stand foot pedal assembly incorporating a pneumatic return in accordance with another embodiment of the invention; and FIG. 11 is a partial front view of the hi-hat stand foot pedal assembly shown in FIG. 10.

DETAILED DESCRIPTION OF THE DRAWINGS

Figure 1:
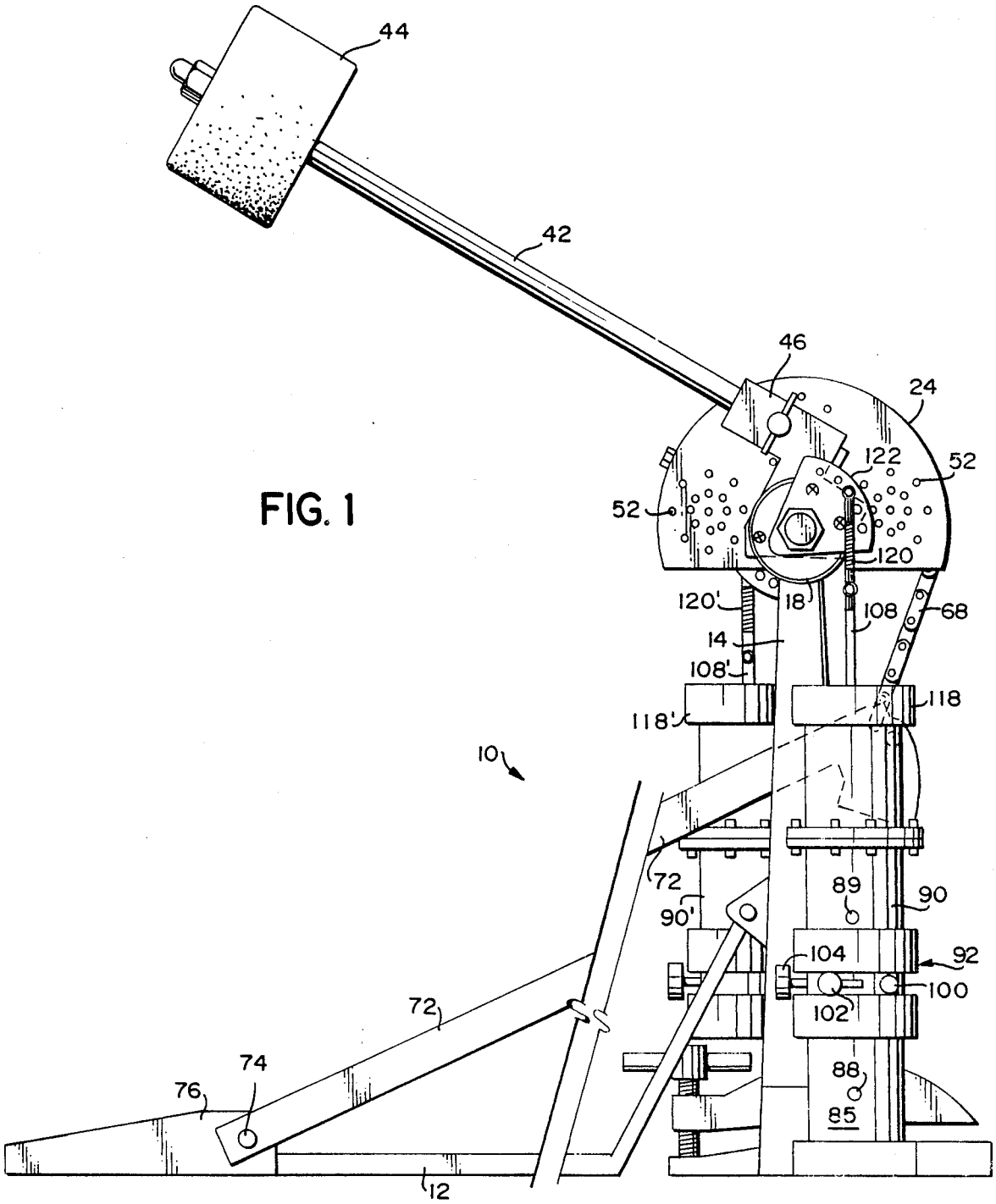
FIG. 1 is a side view of a drum foot pedal assembly provided with a pneumatic return and damping mechanism in accordance with the invention.

Referring now to FIGS. 1 through 6, the drum pedal assembly 10 of this invention includes a base or yoke 12 which supports a pair of upstanding, laterally spaced pedestals 14, 16 which terminate in a pair of enlarged ends 18, 20 between which an axle 22 is mounted for rotation, e.g., by way of shaft bearings or the like.

A main hub 24 is fixed axially along the shaft or axle 22 at a predetermined location by any suitable means, such as set screw 26.

With specific reference to FIGS. 6 and 7, it may be seen that the main hub 24 comprises a relatively thick plate having an arcuate surface 28 (extending about 200°), the opposite ends of which are connected by a flat surface 30. The latter surface need not be flat, but could be of any shape so long as adequate clearance is provided to avoid contact with the drummer's foot. A hexagonal aperture 32 is provided at the radial center of the arcuate surface 28, permitting the hub to be mounted on the shaft or axle 22 as described above. As such, the axle 22 is coincident with the axis of rotation of the hub 24.

Surrounding the aperture 32, at least in part, are a series of smaller apertures 34 which are arranged in three groups of three, namely 36, 38 and 40, as best seen in FIG. 7. These apertures permit adjustable connection or attachment of a beater bar 42, illustrated in detail in FIG. 8. The bar 42 has a beater head 44 attached thereto (in a conventional manner) at one end, and a mounting bracket 46 at the other end, secured by a threaded pin 47 or other suitable means.

The bracket 46 comprises an irregularly shaped plate provided with a circular opening 48 which permits it to be mounted on the axle 22, but rotatable relative to the axle since the diameter of opening 48 is greater than the widest dimension of the hexagonally-cross sectioned axle. The bracket is also provided with three smaller apertures 50 arranged about the larger opening 48. Apertures 50 are sized and spaced so as to match up with any set of three corresponding holes 34, one from each of the groups 36, 38 and 40 provided in the main hub. In other words, the beater bar may be attached to the main hub for rotation therewith in any one of three different positions, each of which varies the initial or neutral position of the bar and, consequently, the stroke length and rotational speed of the bar during movement from a neutral position to a drum engaging position. The attachment of the beater bar to the main hub may be accomplished by screws (not shown) or any other suitable means.

The main hub 24 is also provided with three additional patterns of apertures. These patterns, illustrated most clearly in FIG. 7 at 54*a*, 54*b* and 54*c*, each comprise a central aperture and a pair of surrounding, and successively larger, rings of apertures 52. The apertures in the respective patterns are utilized for adjustably mounting a track hub 56 as described below.

With reference to FIGS. 6 and 9, track hub 56 also comprises a relatively thick plate having an arcuate surface 58. An oversized opening 60, is provided in the track hub for a purpose described below. The track hub is also provided with three smaller apertures 62*a*, *b* and *c* located radially about a center 22′ of the arcuate surface 55. The apertures 52 in main hub 24, and 62 in track hub 56, are located so that the track hub may be mounted to the main hub in any one of seventeen positions (corresponding to the number of apertures 52 in any one of the patterns 54*a*, 54*b* and 54*c*). Thus, when aperture 62*a*, for example, of the track hub is aligned with any of the apertures 52 in pattern 54*a*, the remaining two apertures 62*b* and 62*c* may be aligned with corresponding apertures in patterns 54*b* and 54*c*.

When the track hub is bolted to the main hub using the center holes in each of the patterns 54*a*, 54*b* and 54*c*, the track hub acts as a true center sprocket, rotating about the axis of rotation 22′ (FIG. 9) of axle 22, placing the track hub into any of the other available holes creates an eccentric or off-center hub for the chain to ride on during movement of the pedal. With an off-center arrangement, it is possible to produce the fastest beater bar speed at the desired position of beater bar travel. In other words, the fastest beater bar speed can be achieved when the beater bar is closest to the drum head. Of course, many different eccentric set-ups are possible with the invention, utilizing other corresponding apertures in the patterns 54*a*, 54*b* and 54*c*, so that the acceleration characteristics of the beater bar can be varied as desired.

Figure 3:
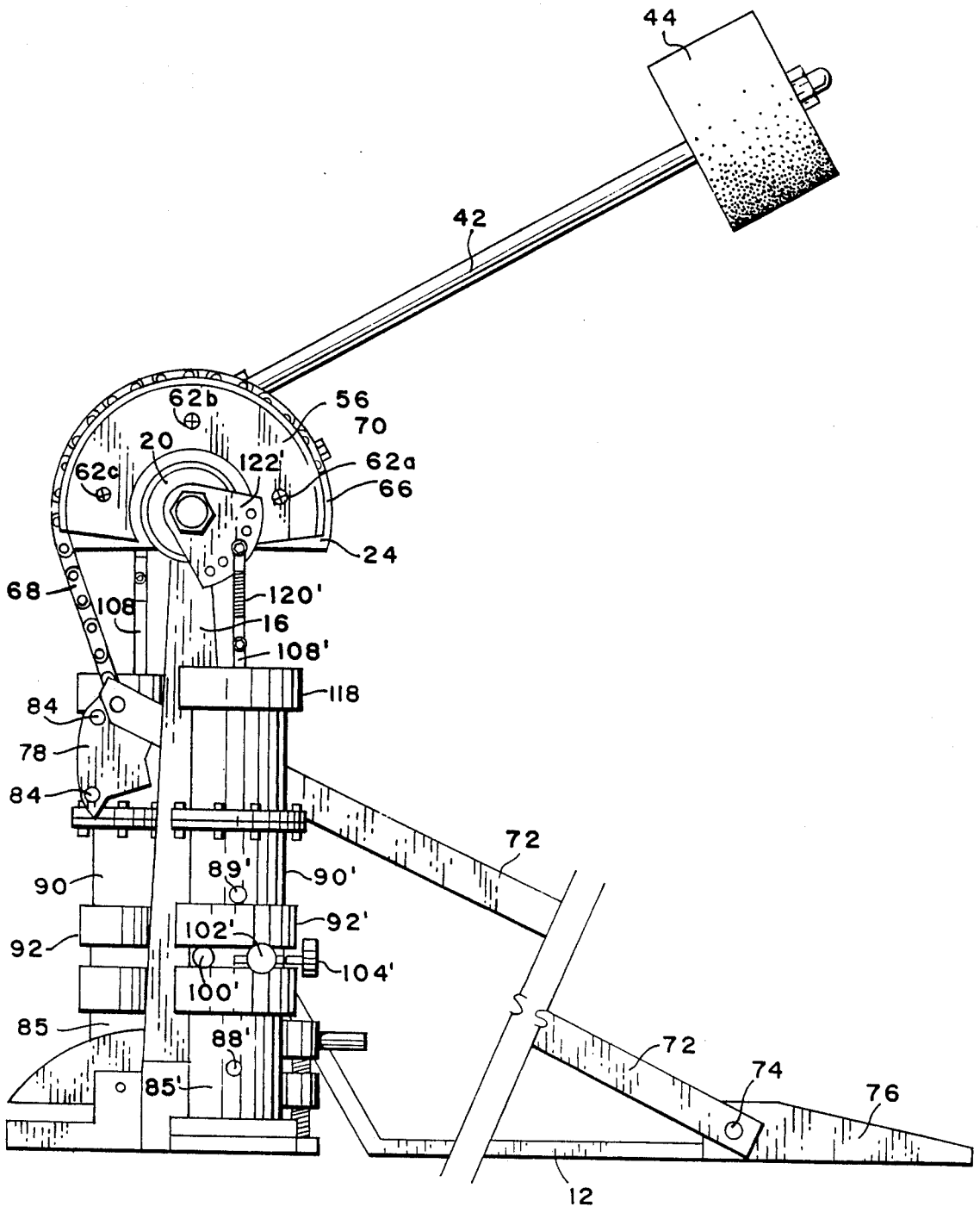
FIG. 3 is a side view taken from the opposite side of the assembly that illustrated in FIG. 1.

The track hub is formed with a peripheral groove 66 (FIGS. 6 and 9) which is adapted to receive a chain 68, one end of which is fixed by a screw or other suitable means to the track hub near one end of the groove 66, for example, at 70 as shown in FIG. 3. While groove 66 is shown to have a smooth surface, it could also be formed as a conventional sprocket including teeth engageable with links on the chain 68.

The opposite end of the chain 68 is attached to an elevated end of a footboard or pedal 72 which, in turn, is pivotally mounted via pin 72 to a base portion 76 of the base 12. The chain 68 may be fixed directly to the forward end of the footboard or pedal 72 by a pin 80 extending between a pair of upstanding lugs 82. Alternatively, the chain 68 may be fastened to a footboard cam or bracket 78 (FIGS. 3, 6) as will be described in greater detail below. It will be understood that the groove 66 has a plurality of threaded holes (not shown) radially arranged at spaced locations therealong to provide alternative attachment points for the chain.

The footboard cam 78, as best seen in FIGS. 3 and 6 may be secured to the footboard by screws (not shown) which extend through the footboard into the cam. With particular reference to FIGS. 3 and 6, the cam 78 is provided with a central groove 79 and a plurality of spaced apertures 84 which may also be utilized to connect the chain to the pedal. It will be appreciated that this allows the inclination of the pedal 72 (in the neutral position) to be altered to a desired degree, relative to horizontal. Moreover, the design of the cam 78, and placement of mounting holes 84 therein, is such that the cam 78 may be removed and reversed, to provide additional mounting positions.

For example, since the cam 78 is designed with a varying radius along its peripheral surface, when the chain 68 is connected to the lowermost hole 84 in the cam, the chain (wrapped about the cam surface), will accelerate the beater bar 42 as the footboard or pedal 72 is depressed, thus providing different "feel" and beater bar timing for each of the various possible settings. Reversal of the cam 78 provides a different radius action, with an even further change in "feel" and beater bar timing.

To this point, it will be appreciated that by pressing the footboard or pedal 72 downwardly, the chain 68 causes the main hub 24 and track hub 56 to rotate along with the axle 22, thereby also causing the beater bar 42 and beater head 44 to rotate forwardly (clockwise in FIG. 1) into striking engagement with an associated drum. Pneumatic means in accordance with the invention for controlling return movement of the beater bar and pedal to a neutral position, with or without pneumatic damping means, will now be described.

With reference again to FIGS. 1 through 6, a pneumatic pedal return mechanism is mounted to the yoke or base 12 on the left side of the pedal assembly as seen in FIG. 6. The pneumatic return mechanism comprises cylindrical housing 85 which defines a main pressure chamber 86 that holds a gas under pressure. The gas is charged into the pressure chamber 86 through a gas fill valve 88, preferably at the time of assembly of the unit. A cylinder 90 is mounted atop housing 85 via a coupling 92 which may be threadably secured therebetween. The coupling 92 is provided with a pair of passageways 94, 96 which establish communication between the pressure chamber 86 and a compression chamber 98 within the cylinder 90. A conventional needle valve 100 which extends into passageway 96 is used to control the flow of gas into the adjacent compression chamber 98. It will be understood that once the desired pressure is reached in the compression chamber, needle valve 100 is closed to seal the respective chambers.

A pressure gauge valve 102 mounted in the coupling 92, extends into passageway 94 and is rotatable therein to indicate pressure, via gauge 104, in each of the chambers 86 and 98. It will be appreciated that during actual use of the pedal, the pressure gauge valve 102 may also be rotated to a third or neutral position which seals the passageway 94 relative to each chamber 86 and 98 as well as gauge 104.

Within the compression chamber 98, there is a piston and rolling diaphragm assembly 106. This assembly includes a piston rod 108, piston 110 and diaphragm 112. The peripheral edge of diaphragm 112 is fixedly secured between abutting peripheral flanges 114, 116 provided in the cylinder 90, while the center of the diaphragm is attached to the piston 110 with the aid of a conventional threaded fastener and backing plate arrangement for reciprocal movement therewith. The rolling diaphragm concept is not a new one, and one exemplary construction is known as the Bellofram Rolling Diaphragm, described in U.S. Pat. Nos. 3,137,215 and 3,373,236.

The upper end of the piston rod 108 extends through a cylinder cap 118 and is attached, via a dual pivot link arm 120, to an axle cam 122, fixedly secured to axle 22 by a bolt 124 (or other means) for rotation therewith. The axle cam 122 is provided with a plurality of apertures 126 so that the link arm 120 can be attached thereto (by a bolt or other suitable means) in any one of a number of (five shown) positions.

It will be appreciated that when the footboard or pedal 72 is depressed, the axle cam 122 rotates and varies the moment arm of the dual pivot link arm 120 so that, by adjusting the point of attachment between link arm 120 and axle cam 122, a different "feel" is provided by reason of the increasing and/or decreasing radii.

As indicated above, the main pressure chamber 86 can be charged with gas from any suitable external source, via the fill valve 88. However, air may also be utilized as the gas medium and it is possible to charge the main pressure chamber without a pressurized external source by the following procedure: (1) open the needle valve 100; (2) manually depress the diaphragm assembly 106 downwardly; (3) close the needle valve 100; (4) open/remove cap from one-way intake valve 89; (5) manually displace the diaphragm assembly 106 upwardly to thereby suck gas into the compression chamber through the intake valve; (6) open the needle valve; (7) manually depress the diaphragm assembly downwardly; and (8) close the needle valve, and then repeat steps (5) through (8) until the desired pressure is achieved. Of course, the intake valve 89 must be closed or capped prior to use.

In the event it is desired to reduce the pressure in compression chamber 98, gas may be routed back to the main chamber 86 by opening the needle valve 100 and thereafter physically displacing the diaphragm assembly 106 downwardly, and then closing the needle valve.

Figure 2:
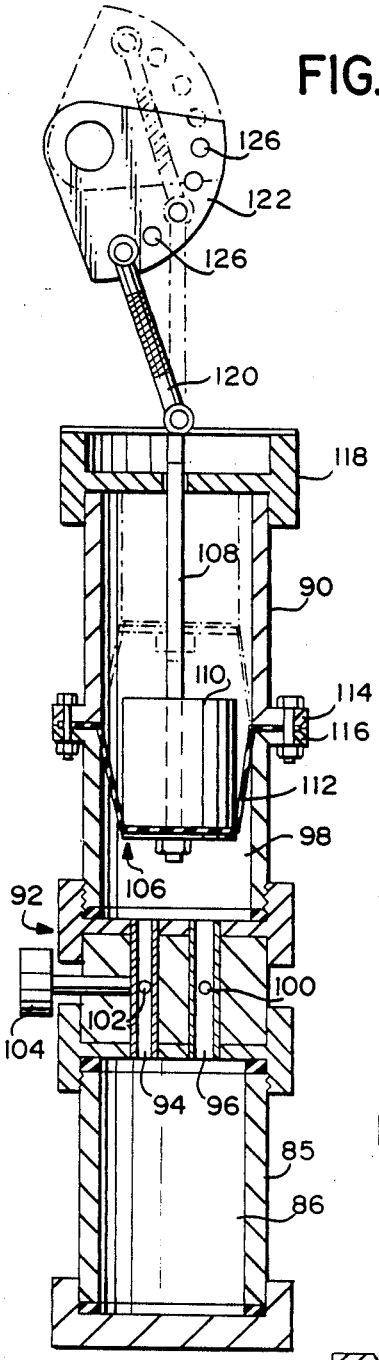
FIG. 2 is a side cross-sectional view of a pneumatic return mechanism in accordance with the invention.
Figure 5:
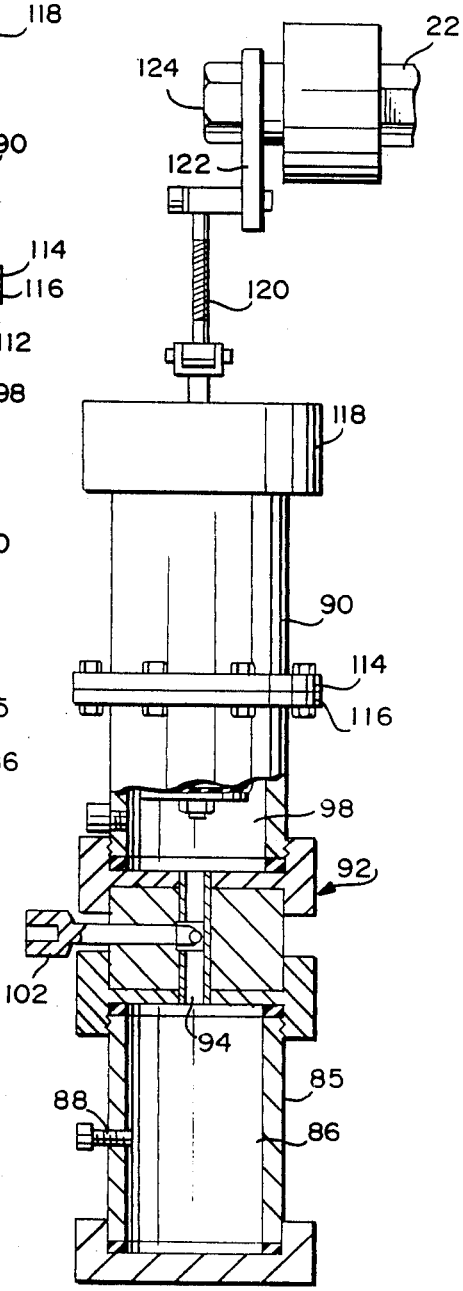
FIG. 5 is a front view, partially sectioned, of the pneumatic return mechanism illustrated in FIG. 2.
Figure 4:
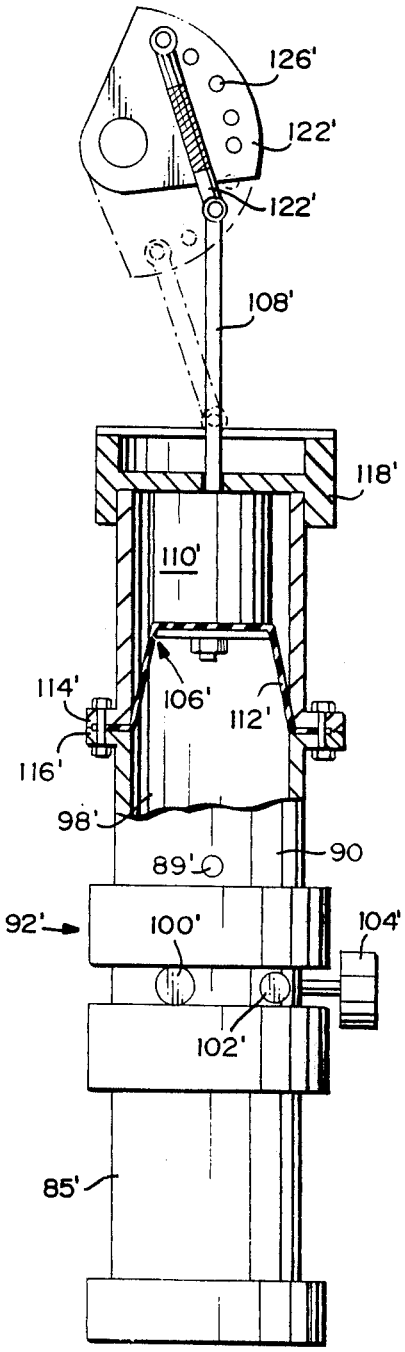
FIG. 4 is a partial side cross-sectional view of a pneumatic damping mechanism in accordance with the invention.

In use, as the footboard or pedal 72 is depressed and axle cam 78 rotated, the piston rod 108, piston 110 and diaphragm 112 will move downwardly within chamber 98 to compress the gas therein, as shown in the solid line configuration in FIG. 2, and beater bar 42 and associated head 44 will rotate into engagement with the drum. It will be appreciated that the piston travel is limited by the end walls of the cylinder or other suitable stop means to insure that the diaphragm is not "over driven." Once the pedal is released, the compressed gas in chamber 98 will expand, causing reverse movement of the diaphragm assembly 106, including piston rod 108, piston 110 and diaphragm 112 (as shown in phantom in FIG. 2) and consequently reverse rotation of axle cam 122 and axle 22 to thereby return the footboard or pedal 72 to its neutral position.

In accordance with another aspect of the invention, return movement of the footboard or pedal 72 may, if desired, be dampened by a similar pneumatic unit which is arranged to provide resistance to the return movement. The pneumatic components of the damping unit are essentially identical to those described above, and are therefore denoted by similar reference numerals but with a prime suffix.

The difference between the two units lies in the fact that the pneumatic return unit is located to one side, or forward of the axis of rotation of axle 22 (to the right in FIG. 1), while the pneumatic damping unit lies behind, or to the other side of the same axis of rotation (to the right in FIG. 3). As a result, rotation of the axle 22 causes the respective axle cams 122, 122' and respective rolling diaphragm assemblies 106, 106' to move in opposite directions. Thus, as the pneumatic return assembly is returning the footboard or pedal 72 to its neutral position as a result of expansion of gas in chamber 98, the pneumatic damping unit is resisting, or damping the return movement by compression of gas in chamber 98'. Of course, the pressure in the respective chambers 98, 98′ will be adjusted to assure positive return movement of the footboard or pedal to its neutral position, and the relative pressures can be adjusted by needle valves 100, 100′ to provide the desired characteristics and "feel" in this regard. Negative pressure may be achieved in the dampening unit which will result in providing a return assist action.

It will therefore be appreciated that the above-described invention provides multiple adjustments, both mechanical and pneumatic, which enable a user to customize or fine tune the drum pedal assembly to a degree heretofore unattainable in conventional pedal return mechanisms.

In still another embodiment, a pneumatic return assembly is incorporated into a hi-hat stand unit, part of which is shown in FIGS. 10 and 11. The remainder of the hi-hat stand is entirely conventional and need not be shown or described for purposes of this invention. Similar reference numbers to those used in FIGS. 1–9 (but with a double prime suffix) are used in FIGS. 10 and 11 to refer to components common to the footboard or pedal pneumatic return system described hereinabove.

The hi-hat stand includes a vertically extending actuator rod 130 extending through a main vertical support member 132. As will be appreciated by those skilled in the art, rod 130 is fastened at an upper end to an upper one of two cymbals (not shown), the upper one being movable downwardly into engagement with the lower of the two and which in conventional stands, is returned upwardly to a neutral position by a coil spring.

The vertical rod 130 is attached at its lowermost end to a chain 68″ which, in turn, is connected to a footboard or pedal 72″ or to a connecting footboard cam 78″.

In order to incorporate a pneumatic return in accordance with this invention, and with reference to FIG. 11, an inverted U-shaped bracket 134 is secured to the bottom of the rod 130 by a threaded nut or similar fastener means. The bracket 134 mounts a chain link of chain 68″ between the depending sides 136, 138 thereof by means such as locking pin 140.

The bracket 134 extends generally perpendicular to the rod 130 in order to provide a rigid offset connection via pin 142 between the vertical rod 130 and the vertical piston rod 108″ of a pneumatic return unit mounted between a pair of pedestals 14″, 16″. In this manner, when footboard 72″ is depressed, chain 68″ will act to pull the rod 130 downwardly, and because of the rigid linkage between rod 130 and piston 110″ via bracket 134, the piston rod 108″ will also move downwardly to effect compression of gas within the compression chamber in the same manner as described hereinabove with respect to the drum pedal return mechanism. Release of the pedal will permit the gas in the compression chamber to expand, reversing the movement of piston rod 108″, rod 130 and footboard or pedal 72″.

Thus, through the utilization of the adjustable mounting of chain 68″ to the footboard or pedal 72″, or making use of cam 78″, and the further utilization of an adjustable, pneumatic return unit, a user is able to fine tune or customize the hi-hat stand to achieve the desired characteristics and "feel" in much the same manner as in the drum pedal embodiment. If desired, a pneumatic damping unit may be utilized to control the return movement.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pneumatic pedal assembly for a musical instrument comprising:

a frame supporting a pedal for movement about a first axis located adjacent one end of the pedal;

a musical component operatively connected to another end of the pedal remote from said first end, said component being supported for movement in a first direction responsive to movement of said pedal from a first neutral position; and first pneumatic means responsive to movement of said pedal in said first direction to return said pedal to said neutral position.

2. A pneumatic pedal assembly as defined in claim 1 wherein said musical component is operatively connected to said another end of the pedal by means of flexible connector means.

3. A pneumatic pedal assembly as defined in claim 2 wherein said flexible connector means comprises a chain adjustably attached to said pedal.

4. A pneumatic pedal assembly as defined in claim 1 wherein said musical component is supported for rotation on a first hub mounted on an axle for rotation about a second axis.

5. A pneumatic pedal assembly as defined in claim 4 wherein said first hub is provided with plural mounting means for supporting said musical component in any one of a plurality of positions relative to said second axis.

6. A pneumatic pedal assembly as defined in claim 4 wherein said first pneumatic means comprises a first piston and first cylinder;

said first piston being adjustably attached to a first cam mounted for rotation on said axle.

7. A pneumatic pedal assembly as defined in claim 6 wherein a first rolling diaphragm is attached to said first piston.

8. A pneumatic pedal assembly as defined in claim 6 wherein said first piston is movable in said first cylinder to compress fluid in a first compression chamber upon movement of said pedal from said neutral position.

9. A pneumatic pedal assembly as defined in claim 8 wherein said first pneumatic means further includes a first main pressure chamber for supplying fluid to the first compression chamber.

10. A pneumatic pedal assembly as defined in claim 9 and further comprising first means for controlling the amount of fluid supplied to the first compression chamber from the first main pressure chamber.

11. A pneumatic pedal assembly as defined in claim 1 and further comprising second pneumatic means for damping return movement of said pedal to said neutral position caused by said first pneumatic means.

12. A pneumatic pedal assembly as defined in claim 10 further comprising second pneumatic means for damping return movement of said pedal to said neutral position caused by said first pneumatic means and wherein said second pneumatic means comprises a second piston and second cylinder, said second piston being adjustably attached to a second cam mounted for rotation on said axle.

13. A pneumatic pedal assembly as defined in claim 12 wherein a first rolling diaphragm is attached to said first piston and a second rolling diaphragm is attached to said second piston.

14. A pneumatic pedal assembly as defined in claim 12 wherein said second piston is movable within said second cylinder to compress fluid in a second compression chamber upon return movement of said pedal toward said neutral position.

15. A pneumatic pedal assembly as defined in claim 14 wherein said second pneumatic means further comprises a second main pressure chamber for supplying fluid to said second compression chamber.

16. A pneumatic pedal assembly as defined in claim 15 and further including second means for controlling the amount of fluid supplied to the second compression chamber from the second main pressure chamber.

17. A pneumatic pedal assembly as defined in claim 1 wherein said musical component is a drum beater.

18. A pneumatic pedal assembly as defined in claim 1 wherein said musical component is a hi-hat stand.

19. In a percussion instrument which includes a pedal assembly which actuates a component in response to movement of the pedal in a first direction away from a neutral position, the improvement which comprises:

first means for pneumatically returning said pedal to said neutral position.

20. A percussion instrument as defined in claim 19 wherein said first pneumatic means includes a first compression chamber and a first rolling diaphragm assembly including a piston, piston rod and flexible diaphragm.

21. A percussion instrument as defined in claim 19 wherein said instrument comprises a bass drum.

22. A percussion instrument as defined in claim 19 wherein said instrument comprises a hi-hat stand.

23. A percussion instrument as defined in claim 19 and further comprising second pneumatic means for damping movement of said pedal to said neutral position.

24. A percussion instrument as defined in claim 23 wherein said instrument comprises a bass drum.

25. A percussion instrument as defined in claim 23 and wherein said second pneumatic means includes a compression chamber and a rolling diaphragm assembly including a piston, piston rod and flexible diaphragm.

26. A percussion instrument as defined in claim 23 wherein said component is mounted on an axle for rotation about a first axis, and wherein said first and second pneumatic means are operatively connected to said axle on opposite sides of said axis, such that rotation of said axle causes movement of said first pneumatic means in one direction, and corresponding movement of said second pneumatic means in an opposite direction.

27. In a pedal actuated drum beating apparatus, the combination comprising:

a support base;

two upright pedestals supported by said base;

a horizontal axle supported for rotation between said pedestals;

a main hub member mounted on said axle, said main hub adjustably mounting a drum beater bar for rotation with said axle;

a track hub member adjustably mounted on said main hub;

a pedal having a rear portion pivotally mounted to said support base and a forward portion operatively and adjustably attached to said track hub so that depressing said pedal results in pivotal movement of said beater bar in a first direction; and first pneumatic means operatively connected to said axle for moving said beater bar in a second direction opposite said first direction.

28. A pedal actuated drum beating apparatus as defined in claim 27 and wherein said first pneumatic means is operatively connected to said axle by means of an axle cam mounted on said axle, said axle cam provided with a plurality of apertures for adjustable connection with a link arm attached to said first pneumatic means.

29. A pedal actuated drum beating apparatus as defined in claim 28 wherein said pedal is operatively attached to said track hub by an elongated flexible member adjustably connected at one end to said track hub, and adjustably connected at the other end to said pedal.

30. A pedal actuated drum beating apparatus as defined in claim 29 wherein a pedal cam is mounted on said pedal, said cam being provided with a plurality of mounting locations; and wherein said flexible member is attached to said cam at one of said mounting locations.

31. A pedal actuated drum beating apparatus as defined in claim 30 wherein said pedal cam is adapted for reversible mounting on said pedal to provide different mounting locations for said flexible member.

32. A pedal actuated drum beating apparatus as defined in claim 27 wherein said main hub comprises a disc having an arcuate peripheral surface, and a first plurality of apertures for adjustably mounting said drum beater bar, and a second plurality of apertures for adjustably mounting said track hub.

* * * * *